US006283727B1

(12) United States Patent
Borish et al.

(10) Patent No.: US 6,283,727 B1
(45) Date of Patent: Sep. 4, 2001

(54) METERING PUMP

(75) Inventors: David M. Borish, Morrisville; Robert F. Bean, Spring City; Richard J. Caspar, West Chester, all of PA (US)

(73) Assignee: Milton Bay, Ivyland, PA (US)

( * ) Notice: Subject to any disclaimer, the term of this patent is extended or adjusted under 35 U.S.C. 154(b) by 0 days.

(21) Appl. No.: 09/551,500

(22) Filed: Apr. 18, 2000

(51) Int. Cl.[7] ..... F04B 17/00; F04B 35/00
(52) U.S. Cl. ..... 417/379; 417/395
(58) Field of Search ..... 417/379, 395, 417/388, 385, 387, 393, 401, 44.1, 389, 53; 74/833; 137/115.1

(56) References Cited

U.S. PATENT DOCUMENTS

| | | | | |
|---|---|---|---|---|
| 3,608,575 | * | 9/1971 | Jurisch et al. | 137/115.1 |
| 3,612,727 | * | 10/1971 | Drake | 417/388 |
| 3,765,799 | * | 10/1973 | Ledner | 417/53 |
| 3,910,727 | * | 10/1975 | Flynn et al. | 417/387 |
| 3,914,548 | * | 10/1975 | Rupp | 417/395 |
| 3,937,599 | * | 2/1976 | Thureau et al. | 417/389 |
| 3,961,860 | * | 6/1976 | Ernst | 417/44.1 |
| 4,263,825 | * | 4/1981 | Guslits | 74/833 |
| 4,422,835 | * | 12/1983 | McKee | 417/401 |
| 5,279,504 | * | 1/1994 | Williams | 417/393 |
| 5,647,733 | * | 7/1997 | Augustyn et al. | 417/385 |
| 5,860,793 | * | 1/1999 | Muscarella et al. | 417/38 |
| 5,934,886 | * | 8/1999 | Bushnell | 417/395 |

FOREIGN PATENT DOCUMENTS

| | | | | |
|---|---|---|---|---|
| 117969 | * | 1/1984 | (DE) | F04B/13/00 |
| 332100 | * | 9/1989 | (DE) | F04B/13/00 |
| 1-122131 | * | 5/1998 | (JP) | F04B/13/00 |

* cited by examiner

*Primary Examiner*—Teresa Walberg
*Assistant Examiner*—L Fastovsky

(57) ABSTRACT

The compact, easily useable metering pump results from a structure including a housing (20) with a pumping chamber (34) within the housing (20). A diaphragm (36) is located in the pumping chamber (34). An inlet includes a check valve (50) for allowing fluid to flow to one side of the diaphragm (36) but not the reverse and an outlet including a check valve (56) allows fluid to flow from the pumping chamber (34) but not into it. A pneumatically operated hydraulic pump (16) is located in the housing (20) and cycles the diaphragm (36).

15 Claims, 4 Drawing Sheets

METERING PUMP

FIELD OF THE INVENTION

This invention relates to metering pumps, and more particularly, to a pneumatically operated metering pump.

BACKGROUND OF THE INVENTION

Metering pumps are used in a wide variety of industries. Typical uses include the addition of chemicals in liquid form to a reaction vessel or system or even simply for mixing purposes. Metering pumps are also extensively used in the food industry for metering ingredients into processes for the manufacture of processed foods. Other examples of their use will readily come to the mind of those skilled in the art.

Metering pumps also come in various types. One type of particular interest employs a diaphragm which is alternatively employed to draw the fluid to be pumped into a pumping chamber and then discharge the fluid from the pumping chamber. Usually, but not always, the diaphragm is cycled by a pressure fluid such as a pressurized gas or hydraulic fluid under pressure. Of the two, the latter is preferred because the incompressible nature of hydraulic fluid assures that its use as the pressurizing fluid in a diaphragm pump will cause the pump to operate as a positive displacement device throughout its cycle of operation. Consequently, the metering function of the pump is more accurate. Metering pumps today frequently employ pneumatic air cylinders to drive plungers to pressurize fluid to actuate a diaphragm to meter fluids.

Pumps of this sort work well for their intended purpose but systems in which they are employed may be unnecessarily bulky. Moreover, pumps of this type typically have a limited range of capacity. Where adjustment is provided within the range of capacity, the range is not sufficiently great as to encompass the entire spectrum of possible flow rates for which the pump might be used. Consequently, frequently a pump bought for a particular process because of its capability of operating within a capacity range needed for that particular process cannot be used in another materially different process where a completely different capacity range is required.

The present invention is directed to overcoming one or more of the above problems.

SUMMARY OF THE INVENTION

It is the principal object of the invention to provide a new and improved metering pump. More particularly, it is an object of the invention to provide a new and improved metering pump that is operated by hydraulic fluid under pressure.

An exemplary embodiment of the invention achieves the foregoing object in a metering pump structure including a housing having a pumping chamber within the housing. A diaphragm is moveable in the pumping chamber and separates it into a pumping side for receiving and discharging fluid to be pumped, and a pressurizing side for receiving hydraulic oil under pressure to move the diaphragm. An inlet is provided to the pumping side and includes a check valve for allowing a fluid to be pumped to flow into the pumping side while preventing flow from the pumping side through the inlet. Also provided is an outlet from the pumping side which includes a check valve which allows fluid to be pumped from the pumping side while preventing flow back into the outlet. A hydraulic pump is located in the housing and has a hydraulic piston containing hydraulic side. A port connects the hydraulic side to the pressurizing side of the diaphragm pump and a hydraulic oil reservoir is located in the housing and in fluid communication with the hydraulic side.

In one form of the invention, a bypass device is located in the housing and is connected to the port. The bypass device is operable upon operation of the piston to receive a predetermined amount of hydraulic oil, thereby providing a means of control over the amount of hydraulic oil delivered to the pressurizing side of the diaphragm pump.

In another facet of the invention, a cavity is located in the housing and the hydraulic pump includes a sleeve with an elongated bore removably secured in the cavity and a hydraulic piston reciprocally received in the bore and operated by an actuator for the pump. The use of the sleeve that is removably received within the housing and defines the bore of the hydraulic pump enables the hydraulic pump to be readily repaired in the event of wear caused by operation as well as allows the substitution of sleeves with different size bores receiving different size pistons so that the range of capacity of the pump can be substantially altered over a wide spectrum simply by selectively placing a sleeve with a desired bore size and a desired piston size therein into the pump.

According to still another facet of the invention, a second cavity is located in the housing and is connected to the port. A pressure relief valve is located in the second cavity.

Other objects and advantages will become apparent from the following specification taken in connection with the accompanying drawings.

DESCRIPTION OF THE PREFERRED EMBODIMENT

Figure 1:
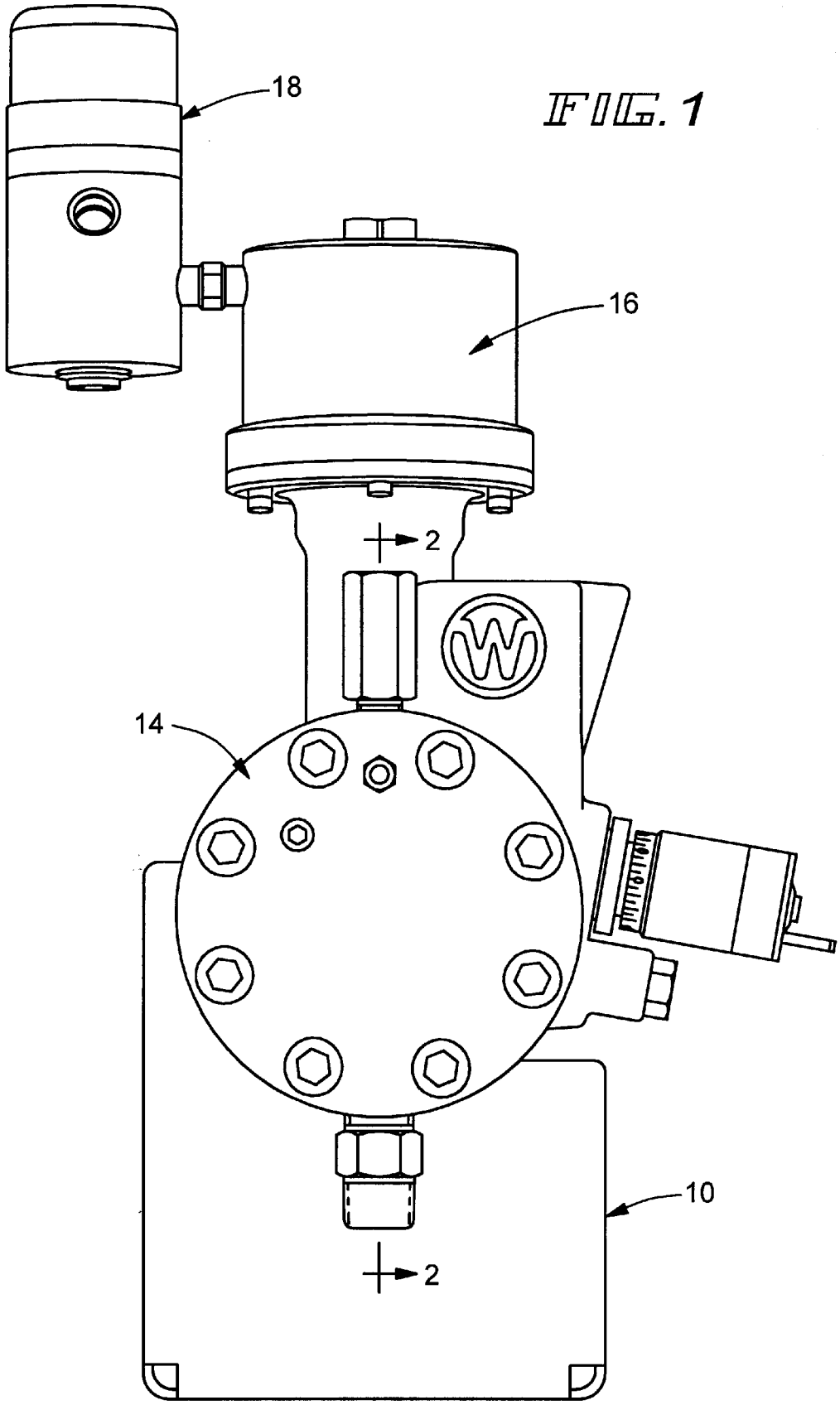
FIG. 1 is a side elevation of a metering pump made according to the invention.
Figure 2:
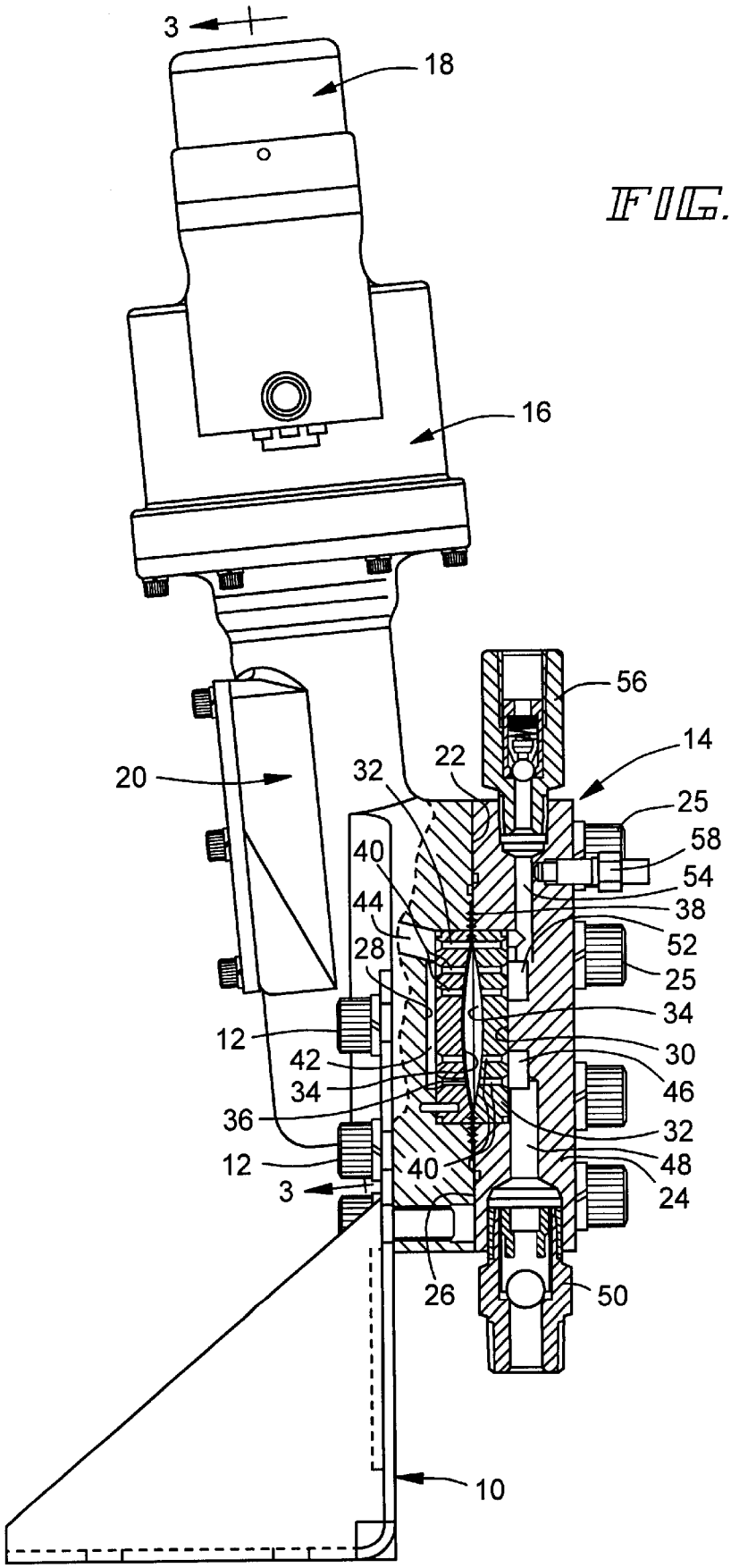
FIG. 2 is a sectional view of the metering pump taken approximately the line 2—2 in FIG. 1.

An exemplary embodiment of a metering pump made according to the invention is illustrated in the drawings. In FIGS. 1 and 2, it is shown as part of a system which includes a mounting base, generally designated 10, which may be formed in the configuration illustrated out of sheet metal or the like. Cap screws 12 may be used to secure the pump to the stand 10. As illustrated in FIGS. 1 and 2, the metering pump itself includes two main components, including a hydraulic section, generally designated 14 and a pneumatic pumping section, generally designated 16. A conventional control, generally designated 18 is employed to regulate the admission of a gas under pressure, typically compressed air, into the pneumatic pumping section 16. It is also to be noted that in some instances, a hydraulic pump other than a pneumatic pumping section such as the pump 16 may be employed. Virtually any type of actuator capable of reciprocating a hydraulic piston could be used if desired.

Turning specifically to FIG. 2, the metering pump is seen to be made up of a housing, generally designated 20, having a diaphragm mounting face 22 which is abutted by a diaphragm head plate 24. Cap screws 25 are employed to secure the diaphragm head plate 24 to the housing 20 in abutment with the face 22.

The face 22, as well as a side 26 of the diaphragm head plate facing the face 22 include respective recesses 28 and 30 which in turn receive identical contour plates 32 which form a major part of the hydraulic section 14. As can be seen in FIG. 2, each of the contour plates 32 includes a shallow recess 34 in one face thereof. The faces having the recesses 34 face each other and a flexible diaphragm 36 is located between the two and held in place by clamping action of the diaphragm head plate 24 against the face 22. To this end, annular serrations 38 may be located in the face 22 and/or the side 26 as well as about the peripheries of the recesses 34 in the contour plates 32.

Each of the contour plates 32 has two annular rows of apertures 40 extending from the recess 34 to the backs or opposite side of the corresponding contour plate 32. These holes are relatively small and in one embodiment, may number twenty five for each of the contour plates 32. It is desirable that the holes be small so as to eliminate any possibility that the diaphragm 36 will be partially or wholly extruded through the holes during operation of the pump. Consequently, a large number of the holes 40 may be required so as to achieve the desired flow capacity.

The diaphragm 36 divides the cavity defined by the recesses 34 into two parts. As viewed in FIG. 2, the right hand part is a pumping part while the part on the opposite side of the diaphragm 36 is a pressurizing part. With respect to the latter, a gallery 42 is in fluid communication with the holes 40 as well as with a port 44 which slants upwardly and toward the pneumatic pumping section 16. Thus, hydraulic fluid under pressure may be admitted to the pressurizing side of the diaphragm 36 to move the same from the position illustrated in FIG. 2 across both of the recesses 34 to provide a pumping stroke. In this regard, a small gallery 46 is in fluid communication with the lower holes 40 in the right hand contour plate 34 as viewed in FIG. 2. The gallery 46 is an inlet gallery and is connected via a port 48 to a conventional check valve 50 which is located as part of an inlet and configured to allow the flow of the fluid to be pumped to the hydraulic section 14 but prevent reverse flow.

An outlet gallery 52 similar to the inlet gallery 46 is also in fluid communication with the upper set of the holes 40 in the right hand contour plate 30 and, via a port 54, is connected to an outlet check valve 56. The outlet check valve 56 serves to allow the flow of the fluid to be pumped from the hydraulic section 14 but prevent reverse flow.

Desirably, a removable bleed plug 58 is threaded through the diaphragm head plate 24 to be in fluid communication with the leak detection port 54.

From the foregoing, it will be appreciated that when the diaphragm 36 is moved to the position illustrated in FIG. 2, the fluid to be pumped will be drawn from a source through the inlet check valve 50 and the inlet port 48 and the inlet gallery 46 into the chamber defined by the recesses 34 on the right hand side of the diaphragm 36. When the diaphragm 36 is subjected to pressure from a fluid applied to the port 44, it will move to the right as viewed in FIG. 2 thereby expelling fluid on the right hand side of the diaphragm into the outlet gallery 52, the leak detection port 54 and through the outlet check valve 56 to a point of use.

Figure 3:
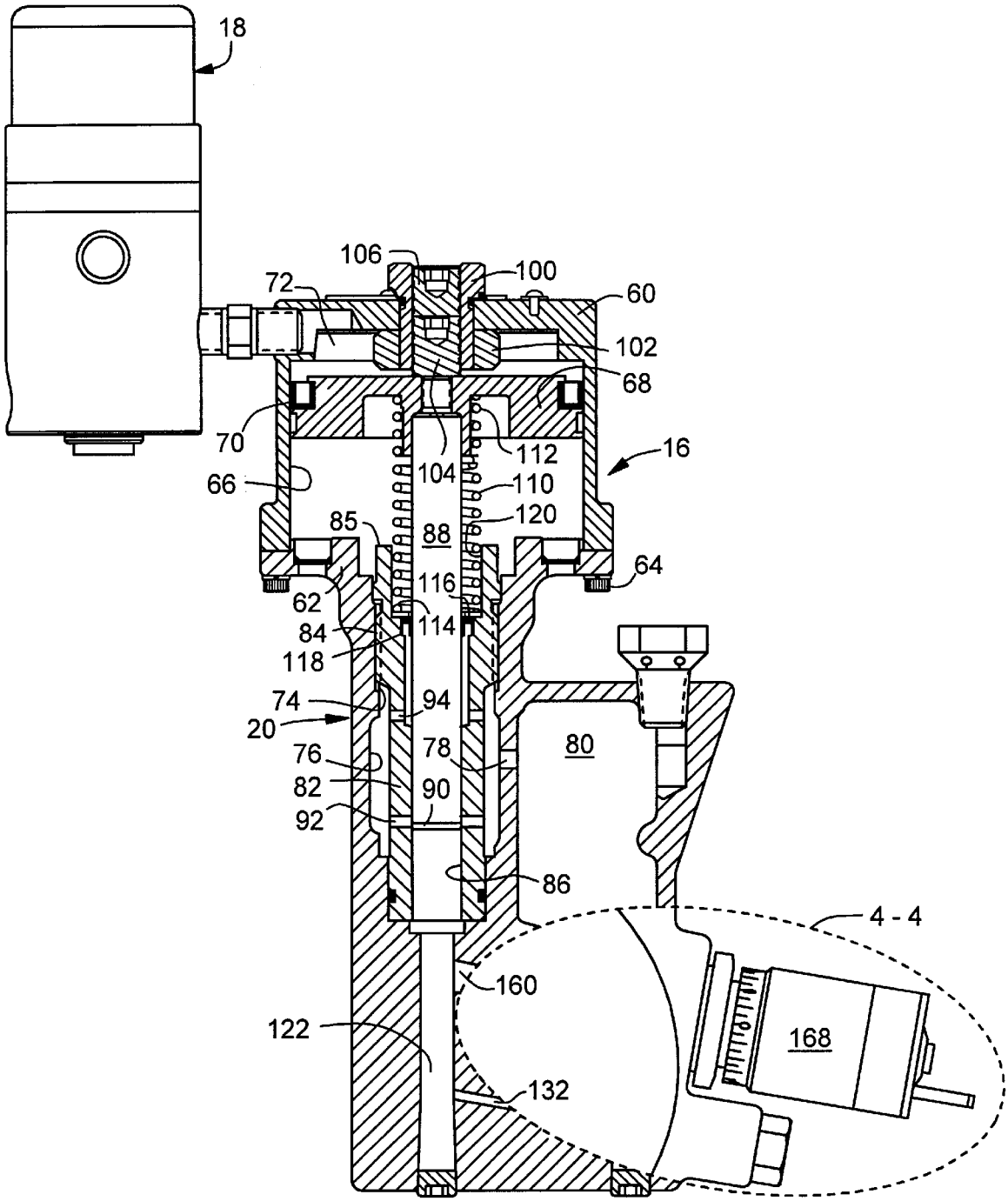
FIG. 3 is a sectional view of the metering pump taken approximately along the line 3—3 in FIG. 2.

Turning now to FIG. 3, the pneumatic pumping section 16 will be described in greater detail. The same includes an inverted cup like housing 60 which may be secured to a flange 62 that extends radially outwardly from the upper end of the housing 20. Cap screws 64 may be used to secure the two together as illustrated.

Within the cup shaped housing 60 is a cylinder 66 for a pneumatic piston 68. The piston 68 carries an upwardly facing seal 70 and an inlet gallery 72 connected to the control 18 is located at the upper part of the cup shaped housing 60. Consequently, the admission of a fluid under pressure to the inlet gallery 72 will result in the same being applied to the upper side of the piston 68.

Within the housing 20 is a first cavity 74. The cavity 74 has an annulus 76 which is in fluid communication, via a port 78, with a reservoir 80 within the housing 20. The reservoir 80 is for hydraulic oil to be used by the pneumatic pumping section 16 in a fashion to be seen.

The cavity 74 removably receives an elongated sleeve 82 which is threaded in place by threads 84 and its upper end is provided with a hex head 85 or other tool receiving configuration to allow easy removal of the sleeve 82 from the cavity 74. The sleeve 82 includes an internal bore 86 in which a hydraulic piston 88 is received. The hydraulic piston 88 is secured to the piston 68. The hydraulic piston 88 also has a slightly beveled lower end 90.

The sleeve 82 has a lower cross bore 92 along with an upper cross bore 94. Both of the cross bores 92 and 94 are in fluid communication with the annulus 76, and thus the reservoir 80.

Returning to the housing 60, at its upper end, the same includes an internally threaded sleeve 100 secured by a nut 102 in a position overlying the piston 68. Within the internally threaded sleeve 100, a plug 104 is located and can be used to control the uppermost position of the piston 68 within the cylinder 66. A lock screw or plug 106 is also located within the internally threaded sleeve 100 to abut the plug 104 to prevent the same from inadvertently rotating.

Initially, the plug 104 is set so that the beveled end 90 of the hydraulic piston 88 just is in fluid communication with the reservoir 80 via the lower cross bore 92 and the annulus 76. As a consequence, when the pneumatic piston 68, and thus the hydraulic piston 88, are in their upper or retracted positions, hydraulic fluid is free to flow into that part of the bore 86 not occupied by the piston 88 via the cross bore 92. Similarly, in such a position, any air that might reach the bore 86 may flow through the cross bore 92 into the annulus 76 and ultimately to the reservoir 80.

As would be appreciated by one skilled in the art, the hydraulic piston 88 is driven downwardly to an extended position by downward movement of the piston 68 as a result of the application of air, gas, liquid under pressure to the upper side of the piston 68. To return the piston 68 to the position illustrated, a compression coil spring 110 is employed, although return of the piston 68 could be effected by fluid or gas under pressure if desired. The compression coil spring 110 surrounds the hydraulic piston 88 and has one end 112 abutting the piston 68 and its opposite end 114 abutting a seal positioning washer 116 which overlies a seal 118 located in a recess 120 within the upper end of the sleeve 82. The compression coil spring 110 thus serves as a means to bias the piston 68 upwardly and carry the hydraulic piston 88 upwardly with it as well. When that occurs, a negative pressure is created in that part of the bore 86 not occupied by the piston 88. The bore 44 to the left side of the pumping chamber of the hydraulic section 14 is connected to a port 122 which in turn is connected to the bore 86. Consequently, the negative pressure is applied to the diaphragm 36 to cause the same to move toward the position illustrated in FIG. 2 thereby drawing fluid into the pumping chamber of the hydraulic section 14 on the opposite side of the diaphragm via the inlet check valve 50.

As mentioned previously, the bore or port 44 slopes upwardly to its point of connection to the bore 122. As a consequence, any gas in the hydraulic system will tend to move through the bore 44 into the bore 122 and to the bore 86 where it may ultimately pass to the reservoir via the cross bore 92 and the annulus 76 when the piston 88 is fully retracted.

The housing 20 also includes a further cavity 130 (FIG. 4) connected via an upwardly sloping bore 132 to the bore 122. The cavity 130 is closed by a plug 134. A pressure relief valve of conventional construction, generally designated 136, is disposed within the cavity 130. The same includes a discharge opening 138 which may discharge into an annulus 140 in the body of the check valve 136 which in turn is in fluid communication with an upwardly directed port 142 within the housing 20. The port 142 is, in turn, in fluid communication with the reservoir 80. As a consequence, should the pressure in the hydraulic fluid being pumped by the piston 88 reach a level in excess of that set on the pressure relief valve 136, the same will open to allow fluid to be diverted via the outlet 138, and the annulus 140 to the port 142 and back to the reservoir 80.

Still another cavity 150 is located in the housing 20 and within the cavity 150 is a hydraulic bypass device.

A sleeve 152 is threaded into the cavity 150 and has a central bore 154 which reciprocally receives a piston 156. The piston 156 has a pressure responsive surface 158 hydraulically facing, via a bore 160, the hydraulic pump 116. As can be seen in FIG. 3, the bore 160 opens to the bore 122 and thus, to the bore 86 in the sleeve 82.

An adjustable stop mechanism 162 is also mounted to the housing 20 and includes a stop surface 164 which may abut the piston 156 to limit its travel within the bore 154. The stop mechanism 162 also mounts a biasing spring 166 which tends to bias the piston 156 to the position illustrated in FIG. 4.

On the exterior of the housing 20, the stop 162 mechanism includes a conventional Vernier actuator 168. By adjustment of the Vernier 168, the position of the stop surface 164 relative to the piston 156 may be selectively altered and adjusted. As a consequence, permitted travel of the piston 156 within the bore 154 can be selectively adjusted. In the position of the components illustrated in FIG. 4, no travel whatsoever of the piston 156 is permitted.

Finally, a cross bore 170 extends from the interface of the piston 156 and the sleeve 152 to the bore 142. Consequently, any leakage of hydraulic oil about the piston 156 will be returned to the reservoir 80. The capacity of the pump may be finally tuned through operation of the Vernier 168. Specifically, the volume of hydraulic fluid for each stroke of the hydraulic piston 88 that is ultimately applied to the diaphragm 36 is adjusted by the bypass device 168. If the maximum fluid for full displacement of the diaphragm 36 is desired, the Vernier 168 may be adjusted so that piston 156 cannot undergo any travel within the bore 154. As a consequence, all of the hydraulic fluid pumped by the hydraulic piston 88 will be applied to the diaphragm 36 to provide for maximum displacement of the same as the pump cycles.

When a lesser flow is required, the Vernier 168 is operated to allow the piston 156 to move within the bore 154. The spring 166 is a relatively light spring and as a consequence, when hydraulic pressure builds up as a result of reciprocation of the piston 88, the piston 156 will shift to the right as viewed in FIG. 4 until it encounters the stop surface 164. The length of travel of the piston 156 in that circumstance multiplied by the cross-sectional area of the bore 154 determines the amount of hydraulic fluid that is bypassed, i.e., prevented from being directed to the diaphragm 36, thereby reducing the displacement of the diaphragm 36 by a commensurate volume. Consequently, fine tuning of system capacity is readily enabled with the system.

It will also be appreciated that the internal incorporation of the pressure relief valve 136 eliminates external piping to return the discharge of the pressure relief valve 136 to the hydraulic reservoir for the system. It also provides a smaller system package as well. Similarly, the use of the removable sleeve 82 provides several advantages as well. For one, in the case of wear, it may be readily replaced, thereby avoiding any need for possible discarding of the pump. Secondly, sleeves 82 with piston receiving bores 86 and pistons 88 to fit such bores may be made with the bores of different sizes or diameters so that the volume of hydraulic fluid pumped by the hydraulic pump 16 may be varied over an extremely wide range. This, in turn, enables an easy change in the overall capacity of the total metering pump simply by changing from one bore, piston, and stroke adjuster combination to another.

Additionally, the sleeve 82 provides a ready means for mounting the seal 118 to prevent the passage of air into the pumping chamber of the hydraulic part of the valve.

The use of slightly upwardly angled ports within the pump provide an integral air bleed mechanism allowing air to be directed to the reservoir 80 at all times during operation. The initial calibration of the pump is easily obtained simply by placing a small pin through the lower cross bore 92 and supporting the piston 88 upon it. The appropriate adjustments may then be made with the plugs 104, 106 to limit the upward movement of the piston 68, and then the pin in the cross bore 92 removed.

Figure 4:
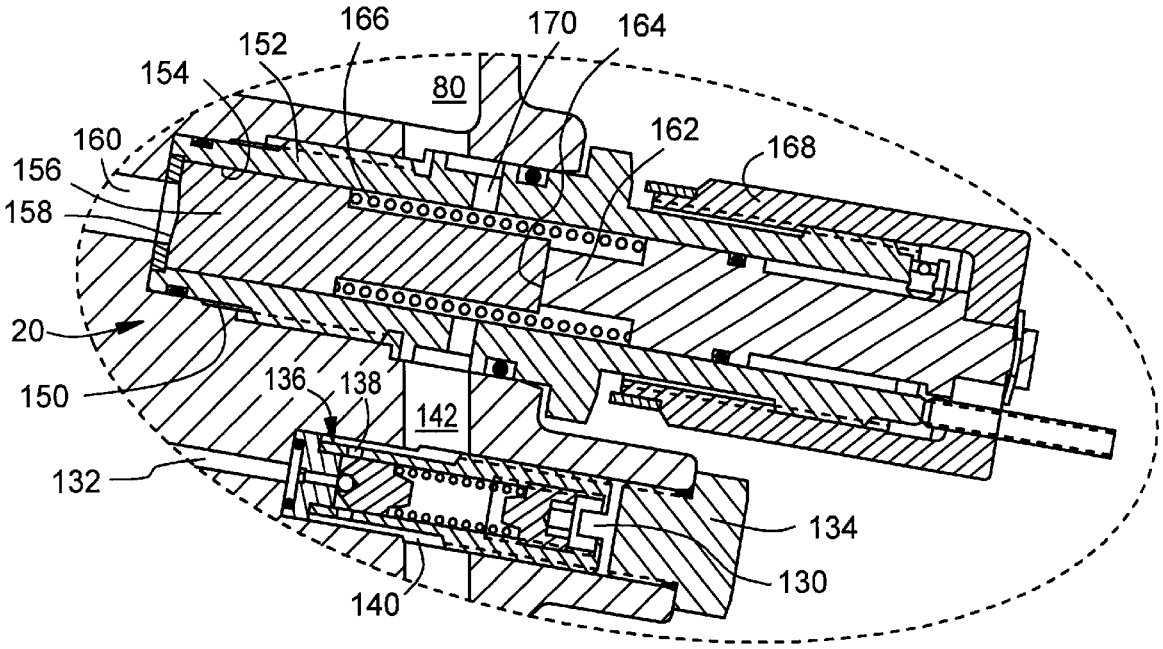
FIG. 4 is an enlarged, fragmentary sectional view of part of the pump structure shown within the line 4—4 in FIG. 3.

The integral bypass mechanism illustrated in FIG. 4 confines the volume control within the innards of the pump housing thereby providing an extremely compact product.

What is claimed is:

1. A metering pump, comprising a housing;

a pumping chamber within said housing;

a diaphragm movable in said pumping chamber and separating the pumping chamber into a pumping side for receiving and discharging fluid to be pumped and a pressurizing side for receiving hydraulic oil under pressure to move the diaphragm;

an inlet to said pumping side including a check valve for allowing a fluid to be pumped to flow into said pumping side and preventing flow from said pumping side through said inlet;

an outlet from said pumping side including a check valve for allowing a fluid to be pumped to flow from said pumping side and preventing flow into said pumping side through said outlet;

a hydraulic pump in said housing and having an actuating side and a hydraulic piston containing, hydraulic side;

a port connecting said hydraulic side to said pressurizing side;

a hydraulic oil reservoir in said housing and in fluid communication with said hydraulic side; and a bypass device in said housing and connected to said port and operable upon operation of said piston to receive a predetermined amount of hydraulic oil.

2. The metering pump of claim 1 wherein said piston is reciprocally movable within a bore in said housing between extended and retracted positions and said bypass device includes a second reciprocal piston hydraulically facing said port, a stop for limiting travel of said second piston, and a spring biasing the second piston in a hydraulic direction toward said port.

3. The metering pump of claim 2 wherein said stop is mounted on an adjustable positioning mechanism in said housing, and an actuator for said adjustable positioning mechanism located on the exterior of said housing so that the position of said stop and the limit of travel of said second piston may be adjusted thereby adjusting the capacity of said metering pump.

4. The metering pump of claim 2 wherein said bore is located within a sleeve, and a cavity in said housing removably receiving said sleeve.

5. The metering pump of claim 4 wherein said cavity includes an annulus in fluid communication with said reservoir and said sleeve includes two spaced cross bores, each intersecting said bore, said cross bores opening to said annulus.

6. The metering pump of claim 4 wherein said sleeve, at one end, has a hex head or other tool receiving formation formed thereon.

7. The metering pump of claim 4 wherein said hydraulic pump is a pneumatically operated hydraulic pump and includes a reciprocal pneumatic piston in said actuating side and connected to said hydraulic piston in driving relation; a seal about said bore and carried by said sleeve in sealing engagement with said hydraulic piston to isolate said hydraulic and actuating sides.

8. The metering pump of claim 7 wherein said sleeve includes a recess about said bore receiving said seal; a seal positioning washer in said recess abutting said seal; and a coil spring in surrounding relation to one of said pistons having an end in said recess abutting said washer and an opposite end abutting said pneumatic piston.

9. The metering pump of claim 1 wherein said port connects to said bore and is angled upwardly in the direction toward said bore to facilitate the bleeding of air.

10. The metering pump of claim 1 further including a pressure relief valve in said housing and in fluid communication with said port.

11. A metering pump, comprising a housing;

a pumping chamber within said housing;

a diaphragm movable in said pumping chamber and separating the pumping chamber into a pumping side for receiving and discharging fluid to be pumped and a pressurizing side for receiving hydraulic oil under pressure to move the diaphragm;

an inlet to said pumping side including a check valve for allowing a fluid to be pumped to flow into said pumping side and preventing flow from said pumping side through said inlet;

an outlet from said pumping side including a check valve for allowing a fluid to be pumped to flow from said pumping side and preventing flow into said pumping side through said outlet;

a hydraulic pump in said housing including a sleeve removably received in a cavity within said housing and having a bore, a piston reciprocally mounted in said bore and an actuator for reciprocating said piston;

a port connecting said hydraulic pump bore to said pressurizing side; and a hydraulic oil reservoir in said housing and in fluid communication with said bore.

12. The metering pump of claim 11 wherein said cavity includes an annulus in fluid communication with said reservoir and said sleeve includes two spaced cross bores, each intersecting said bore, said cross bores opening to said annulus.

13. The metering pump of claim 12 wherein said sleeve, at one end, has a hex head or other tool receiving formation formed thereon.

14. The metering pump of claim 11 including a bypass device in said housing and connected to said port and operable upon reciprocation of said piston to receive a predetermined amount of hydraulic oil.

15. A metering pump, comprising a housing;

a pumping chamber within said housing;

a diaphragm movable in said pumping chamber and separating the pumping chamber into a pumping side for receiving and discharging fluid to be pumped and a pressurizing side for receiving hydraulic oil under pressure to move the diaphragm;

an inlet to said pumping side including a check valve for allowing a fluid to be pumped to flow into said pumping side and preventing flow from said pumping side through said inlet;

an outlet from said pumping side including a check valve for allowing a fluid to be pumped to flow from said pumping side and preventing flow into said pumping side through said outlet;

a first cavity in said housing;

a pneumatically operated hydraulic pump in said housing and having a pneumatic side and a hydraulic side, said hydraulic side including sleeve with an elongated bore removably secured in said first cavity and a hydraulic piston reciprocally received in said bore and operated by said pneumatic side;

a port connecting said hydraulic side bore to said pressurizing side;

a hydraulic oil reservoir in said housing and in fluid communication with said hydraulic side bore;

an inlet for a pneumatic fluid connected to said pneumatic side;

a bypass device in said housing and connected to said port and operable upon operation of said piston to receive a predetermined amount of hydraulic oil;

a second cavity in said housing and connected to said port;

a pressure relief valve in said second cavity; and an additional port in said housing and connecting said pressure relief valve to said reservoir.

* * * * *

UNITED STATES PATENT AND TRADEMARK OFFICE

CERTIFICATE OF CORRECTION

PATENT NO. : 6,283,727 B1
DATED : September 4, 2001
INVENTOR(S) : David M. Borish et al.

It is certified that error appears in the above-identified patent and that said Letters Patent is hereby corrected as shown below:

Title page,
Item [73], Assignee, "Milton Bay" should read -- Milton Roy --

Signed and Sealed this

Sixth Day of August, 2002

*Attest:*

*Attesting Officer*

JAMES E. ROGAN
*Director of the United States Patent and Trademark Office*